US006374441B1

(12) United States Patent
Begell

(10) Patent No.: US 6,374,441 B1
(45) Date of Patent: Apr. 23, 2002

(54) HEADREST FOR CHIROPRACTOR'S TABLE

(76) Inventor: Suzanne Begell, 1421 Butternut, Syracuse, NY (US) 13208

( * ) Notice: Subject to any disclaimer, the term of this patent is extended or adjusted under 35 U.S.C. 154(b) by 0 days.

(21) Appl. No.: 09/510,602

(22) Filed: Feb. 22, 2000

(51) Int. Cl.[7] ..... A47G 9/00; A61G 13/12
(52) U.S. Cl. ..... 5/638; 5/636
(58) Field of Search ..... 5/638, 636, 644, 5/637, 640, 643, 645, 725; 606/204.35; 128/846

(56) References Cited

U.S. PATENT DOCUMENTS

| | | | | | |
|---|---|---|---|---|---|
| 1,542,674 | A | | 6/1925 | Darling | 5/638 |
| 2,461,434 | A | | 2/1949 | Moyers | 5/638 |
| 2,990,558 | A | | 7/1961 | Engel | 5/725 |
| 3,140,497 | A | | 7/1964 | Carswell | 5/638 |
| 3,315,282 | A | | 4/1967 | Lowery et al. | 5/638 |
| 3,337,883 | A | * | 8/1967 | Allison | 5/638 |
| 3,366,106 | A | | 1/1968 | Yao et al. | 5/638 |
| 3,694,831 | A | | 10/1972 | Treace | 5/638 |
| 4,710,991 | A | | 12/1987 | Wilmore et al. | 5/638 |
| 4,757,983 | A | | 7/1988 | Ray et al. | 5/638 |
| 4,908,892 | A | | 3/1990 | Michelson | 5/638 |
| 4,908,893 | A | | 3/1990 | Smit | 5/636 |
| D309,542 | S | | 7/1990 | Glenn | D6/596 |
| 5,347,668 | A | | 9/1994 | Manning | 5/638 |
| 5,537,703 | A | | 7/1996 | Launder | 5/636 |
| 5,613,501 | A | * | 3/1997 | Michelson | 5/638 |
| 5,652,981 | A | | 8/1997 | Singer-Leyton et al. | 5/631 |
| 5,778,887 | A | | 7/1998 | Curtiss | 5/638 |
| 5,865,505 | A | | 2/1999 | Eley | 5/638 |
| 5,893,183 | A | | 4/1999 | Bechtold, Jr. | 5/632 |
| 5,960,494 | A | * | 10/1999 | Gilliand et al. | 5/638 |

* cited by examiner

*Primary Examiner*—Alexander Grosz
(74) *Attorney, Agent, or Firm*—Brown & Michaels, PC

(57) ABSTRACT

A headrest for a chiropractor's table for supporting the user's head by direct engagement with the user's face by supportive engagement with frontal sinus, maxillary sinus and facial bone (especially zygomatic bone) areas of the user's face. By using such facial contours, the headrest of the present invention increases the surface area of contact in specific areas of the face, while the patient is in a prone position. The wider surface area reduces the pressure to the frontal sinus and maxillary sinus regions and the facial bones, thereby increases patient comfort substantially over the prior art.

16 Claims, 3 Drawing Sheets

HEADREST FOR CHIROPRACTOR'S TABLE

FIELD OF THE INVENTION

The present invention pertains to the field of head and neck support and immobilization devices that are used in cooperation with a chiropractic or medical treatment table. More particularly, the invention pertains to headrest apparatus for a chiropractor's table, which provides comfortable support for a patient's head while the patient is lying facedown.

BACKGROUND OF THE INVENTION

During chiropractic therapy it is usually necessary for the patient to lie in a prone position so that the medical attendant may work on the patient's back. Normally the patient lies on a specially designed table. Therapeutic tables upon which a human body can be supported are well known in the orthopedic and chiropractic fields. Such tables normally include support cushions for the ankles, legs, pelvic, thoracic and lumbar regions, as well as the head. The headrest usually includes two opposing rectangular cushions to support the patient's head, and a facial opening such that the patient can lie on the table face-down, while still permitting normal breathing. Such headrest cushions are typically composed of a resilient or compressible material, such as foam rubber or polyurethane, and are covered by a durable protective material, such as leather or plastic.

There are many variations of a face-down pillow or head support structure in the prior art. Some of these are explicitly intended for chiropractic or other medical applications (U.S. Pat. Nos. 3,694,831; 4,710,991; 4,908,892; 5,347,668; 5,652,981; 5,778,887; 5,865,505 and 5,893,183), while others are either for avoiding wrinkles or smearing cosmetics, or just to allow comfortable sleeping face-down. U.S. Pat. No. 3,315,282 "Headrest For Cosmetic Use And The Like" discloses a sloping pillow with recess for the face that has cheek pads and also discloses an embodiment surrounding the face (FIG. 10). U.S. Pat. No. 4,710,991 "Headrest Pillow", which is specifically for chiropractic tables, has two bolsters with lateral head support pads. U.S. Pat. No. 5,652,981 "Maternity Massage Cushion", also for massage, discloses a pillow for supporting a pregnant woman face-down for massage that has facial recess with cheek contact cushion (FIGS. 7 and 8). All of these patents show a face support member contoured to fit the cheeks and forehead of the user. U.S. Pat. No. 1,542,674 "Combined Pillow And Chest Supporter" shows a cross-wise slot for the face, and U.S. Pat. No. 5,778,887 "Face Down Body Support Apparatus" uses a webbing strap to support the forehead over a gap.

SUMMARY OF THE INVENTION

The invention is a cushioned headrest for a chiropractor's table having a substantially U-shaped configuration for receiving and supporting a user's head in a face-down orientation. The dense foam cushion is contoured to support the user's face by direct engagement with the user's face, decreasing the pressure particularly in the area of the frontal sinus and maxillary sinus cavity and facial bones, specifically the bony area around and under the eye (zygomatic bone), by increasing the surface area contacting these areas. A central opening through the cushion, angled in from the contact locations, receives the nose and mouth portions of the user's face and permits free breathing. By using such facial contours, the headrest of the present invention increases the surface area of contact in specific areas of the face, while the patient is in a prone position. The increased surface area decreases pressure to the sinus cavity and facial bone regions, more specifically the Glabella, Zygomatic Arch (process), Temporal Process and Frontal Process. Being contoured to the shape of these facial bones, the invention thereby increases patient comfort substantially over the prior art.

DETAILED DESCRIPTION OF THE INVENTION

Figure 1:
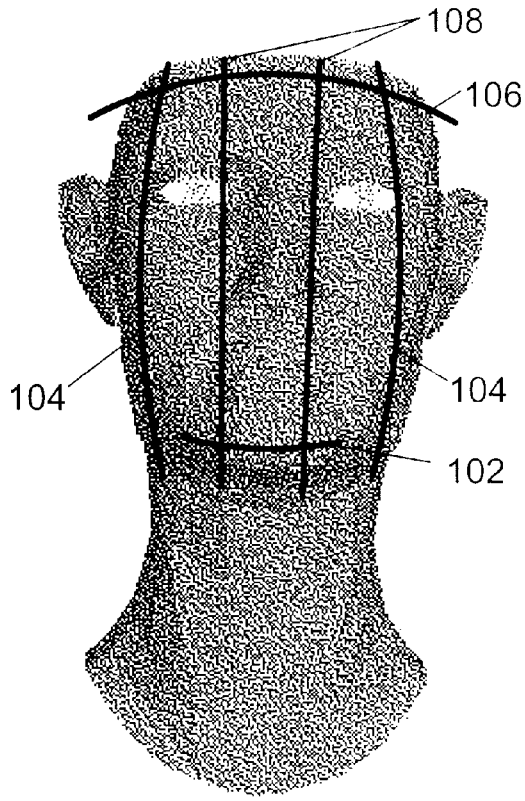
FIG. 1 shows a diagram depicting contours on a human face where the prior art devices engage and support the face of a user.

Referring to FIG. 1, prior art chiropractor's face-down headrests generally support the user's face at the base of the chin 102, at two opposing arcs 104 extending along either side of the face, and along one arc 106 extending across the forehead region. Some simply provide a slot for the nose, and contact the face along lines 108.

Figure 2:
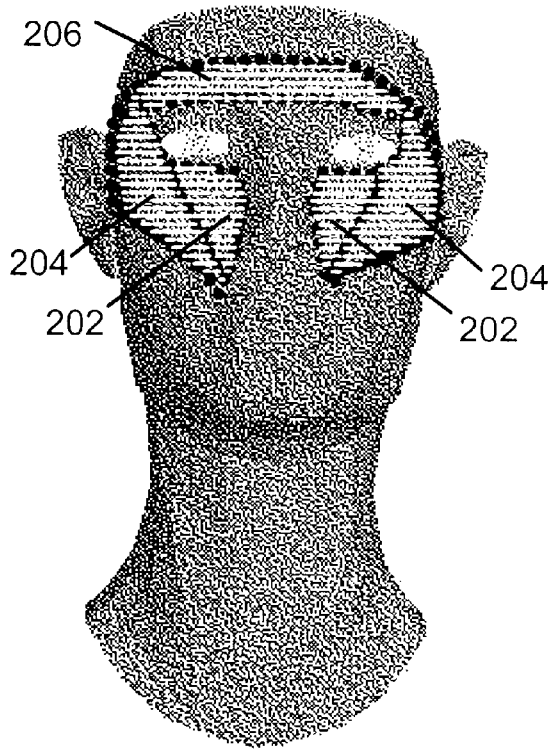
FIG. 2 shows a diagram depicting contours on a human face where the present invention engages and supports the face of a user.
Figure 3:
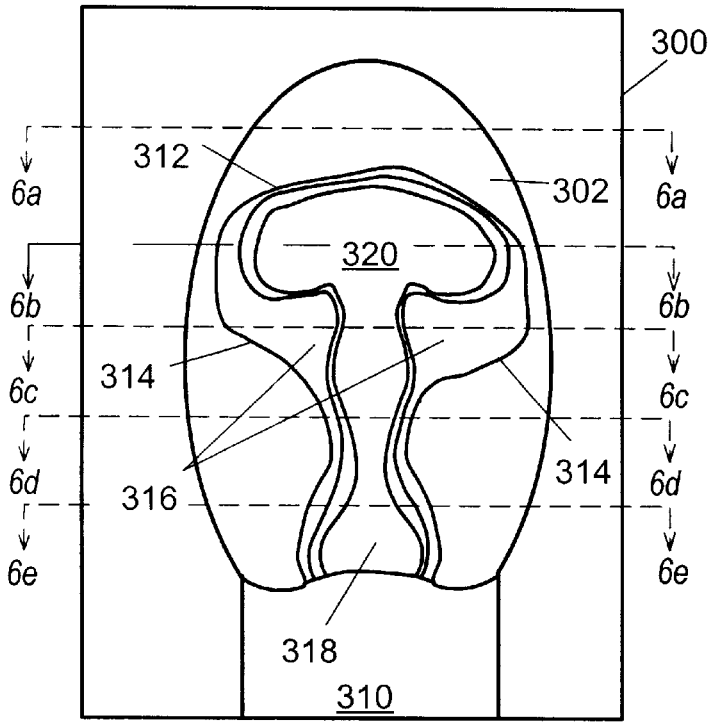
FIG. 3 shows a top view of a cushion of the invention.
Figure 4:
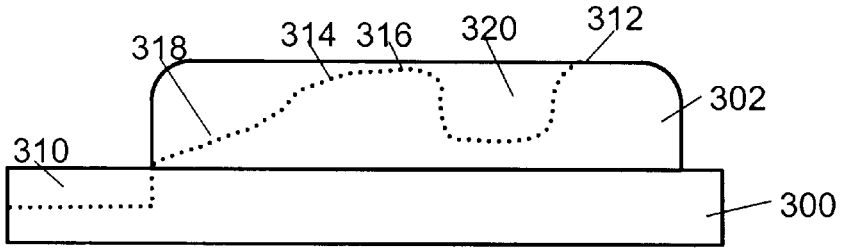
FIG. 4 shows a side view of a cushion of the invention.

Referring to FIG. 2, the headrest of the present invention is contoured to support the user's head specifically at the maxillary sinus cavity (shaded areas 202) and facial bones (especially the zygomatic bones) (shaded areas 204) of the user's face, as well as at the frontal sinus area (shaded area 206). By using such facial contours, the headrest of the present invention increases the surface area of contact in specific areas of the face, while the patient is in a prone position. Thus, the wider surface area reduces the pressure to the frontal sinus and maxillary sinus regions and the facial bones, thereby increases patient comfort substantially over the prior art.

Referring to FIGS. 3 and 4 through 6, in one embodiment the headrest of the present invention includes a cushion 302, with a substantially U-shaped configuration for receiving and supporting a user's head in a face-down orientation. The cushion is mounted to a board or other support 300, which may be attached or clamped to a conventional chiropractor's table in any fashion known to the art. Any means for releaseably attaching to a table are suitable, such as straps or laces, hook and loop fasteners, buckle fasteners, double "D" ring fasteners, buttons, snaps, or any other similar type of suitable fastening means.

In the preferred embodiment, the cushion is composed of a dense foam material, for example, foam rubber, open-cell or closed-cell foam, polyurethane, polystyrene, etc. Slight resiliency of the foam material is preferred, but not essential.

The headrest optionally is covered with a material such as a durable fabric, leather, plastic, vinyl, rubber or any other material suitable for comfort and sanitation purposes.

The cushion 302 may be molded or cast to have the desired facial contours, or it may be formed by cutting away unneeded material from a solid block of foam or other material. It is envisioned that the cushion will normally be formed to fit most adults, but optionally, the cushion is pre-formed to the facial contours of a particular user or to the contours of a general anatomical model.

A central opening, running from the eye area 320 through the nose and mouth 318 provides room for the patient to support his or her head and breathe normally without pressure to the eyes, nose or mouth areas. The opening tapers downward toward the bottom of the cushion, allowing people with different face sizes to center themselves on the cushion and fit comfortably. The frontal sinus area is supported by the upper 312 end of opening 320. Special support areas extend inward into the central opening to contour to the maxillary and frontal sinus cavities 316 and facial bone areas (particularly the zygomatic bone) 314 of the patient's face.

Below the cushion 302, the supporting board 300 may be formed with a slot or recess 310 to accommodate the patient's neck and shoulders. This is common to other prior art head supports.

Figure 5:
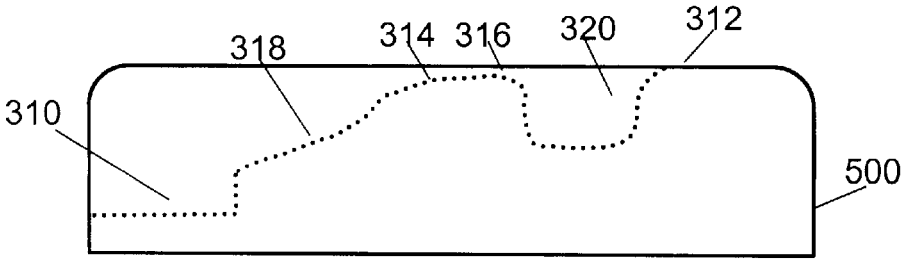
FIG. 5 shows a side view of another embodiment of the cushion of the invention.
Figure 6A:
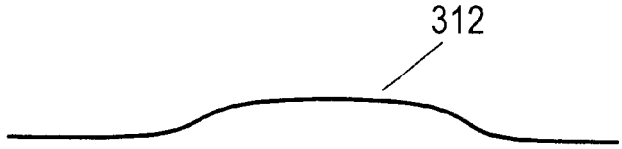
FIGS. 6*a* through 6*e* show contours of the cushion of the invention, at locations indicated by lines 6*a* through 6*e* on FIG. 3.
Figure 6B:
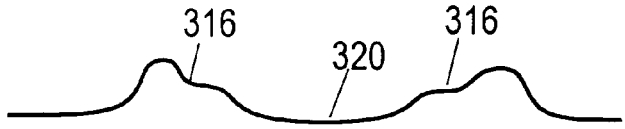
Figure 6C:
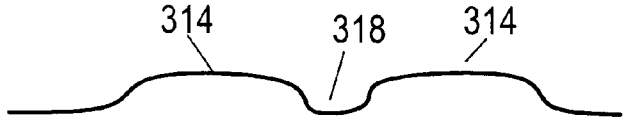
Figure 6D:
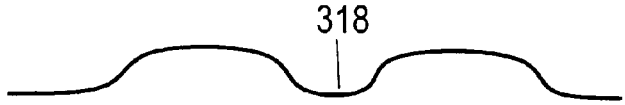
Figure 6E:
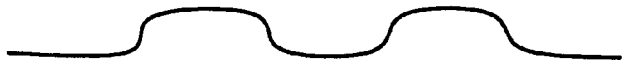

FIG. 5 shows another embodiment of the invention, in which the headrest is formed of a single block of material 500, preferably dense foam or the like. The supporting areas for the frontal sinus area 312, facial bones (especially zygomatic bone) 314, and maxillary sinus area 316, as well as the recesses for the eye 320 and nose and mouth 318 areas, and for the neck 310 are formed into the block, either by molding or by cutting the contours into a solid block of foam or other material.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A headrest for a treatment table for supporting the head of a patient in a face-down posture, comprising:

a cushion having a body with an upper surface contoured with a recess for receiving nose and mouth portions of the face, and a plurality of face support portions contoured for contacting the patient's face at least at the frontal sinus area, the maxillary sinus area and the facial bone area.

2. The headrest of claim 1, wherein said headrest is pre-formed and contoured to a generalized anatomical shape of frontal and maxillary sinuses and facial bone areas.

3. The headrest of claim 1, in which the body is formed of a dense foam material.

4. The headrest of claim 2, wherein said foam material is selected from the group consisting of: open-cell foam; closed-cell foam; foam rubber; polyurethane; and polystyrene.

5. The headrest of claim 1, further comprising a base attached to the cushion opposite the contoured upper surface, for supporting the headrest on a treatment table.

6. The headrest of claim 1, in which the upper surface of the cushion is covered with a durable material.

7. The headrest of claim 6, in which the material is selected from the group comprising vinyl, plastic, fabric, leather, and rubber.

8. The headrest of claim 1, in which the upper surface of the cushion is covered with a durable material.

9. The headrest of claim 8, in which the durable material is selected from the group comprising vinyl, plastic, fabric, leather, and rubber.

10. A headrest for a treatment table for supporting the head of a patient in a face down posture, comprising:

a cushion having a substantially U-shaped configuration, said cushion having a body with an upper surface contoured with a recess for receiving nose and mouth portions of the face, and a plurality of face support portions contoured for contacting the patient's face at least at the frontal sinus area, the maxillary sinus area and the facial bone area.

11. The headrest of claim 10, wherein said maxillary sinus area and facial bone area includes the glabella, zygomatic arch (process), temporal process, and frontal process.

12. The headrest of claim 10, wherein said headrest is pre-formed and contoured to a generalized anatomical shape of frontal and maxillary sinuses and facial bone areas.

13. The headrest of claim 10, in which said body is formed of a dense foam material.

14. The headrest of claim 13, wherein said foam material is selected from the group consisting of open-cell foam, closed-cell foam, foam rubber, polyurethane and polystyrene.

15. The headrest of claim 10, further comprising a base attached to the cushion opposite the contoured upper surface, for supporting the headrest on a treatment table.

16. The headrest of claim 10, in which the upper surface of the cushion is covered with a durable material.

* * * * *